US005732580A

United States Patent [19]

Garnault et al.

[11] Patent Number: 5,732,580

[45] Date of Patent: Mar. 31, 1998

[54] AXIALLY DISENGAGEABLE LOCK FOR A MOTOR VEHICLE LOCKING SYSTEM

[75] Inventors: Joël Garnault, Sannois; Christophe Menager, Saint Maur des Fosses, both of France

[73] Assignee: Valeo Securite Habitacle, Creteil, France

[21] Appl. No.: 853,116

[22] Filed: May 8, 1997

[30] Foreign Application Priority Data

May 10, 1996 [FR] France ..... 96 05831

[51] Int. Cl.[6] ..... E05B 17/04

[52] U.S. Cl. ..... 70/422; 70/360; 70/379 R; 70/380; 70/419; 70/472

[58] Field of Search ..... 70/422, 188, 189, 70/360, 472, 379 R, 379 A, 380, 372, 419, 222, 223

[56] References Cited

U.S. PATENT DOCUMENTS

| | | | |
|---|---|---|---|
| 3,442,102 | 5/1969 | Butts | 70/422 |
| 4,669,287 | 6/1987 | Reader et al. | 70/422 X |
| 4,759,204 | 7/1988 | Neyret | 70/360 |
| 4,773,240 | 9/1988 | Foshee | 70/422 X |
| 4,903,512 | 2/1990 | Leroy et al. | 70/380 X |
| 4,947,664 | 8/1990 | Lindmayer et al. | 70/422 |
| 5,229,747 | 7/1993 | Zhao | 70/422 X |
| 5,577,409 | 11/1996 | Oyabu et al. | 70/422 X |
| 5,640,864 | 6/1997 | Miyamoto | 70/380 X |

FOREIGN PATENT DOCUMENTS

| | | |
|---|---|---|
| 224 104 | 6/1987 | European Pat. Off. . |
| 488 786 | 6/1992 | European Pat. Off. . |
| 571 249 | 11/1993 | European Pat. Off. . |
| 647 752 | 4/1995 | European Pat. Off. . |
| 44 107 83 | 4/1995 | Germany . |

*Primary Examiner*—Lloyd A. Gall
*Attorney, Agent, or Firm*—Morgan & Finnegan, LLP

[57] ABSTRACT

A motor vehicle door lock or the like comprises a locking mechanism for securing and releasing the door, operated by a lock which is disengageable from the locking mechanism. The disengageable lock comprises a stator, a tubular intermediate sleeve, a rotor operable by a key, and a control lever for actuating the locking mechanism. The control lever is coupled to the rotor through a driving sleeve. The lock also includes an indexer which is moveable axially between a rest, or engaged, position and a disengaged position when the intermediate sleeve is rotated during actuation of the rotor by an incorrect key. This axial movement of the indexer displaces the driving member axially to a position in which the driving member is prevented from rotating. The indexer is fixed in rotation to the intermediate sleeve, and is also free to rotate with respect to the stator when in the disengaged position.

10 Claims, 7 Drawing Sheets

AXIALLY DISENGAGEABLE LOCK FOR A MOTOR VEHICLE LOCKING SYSTEM

FIELD OF THE INVENTION

This invention relates to locks for controlling locking mechanisms, e.g. for use in motor vehicles, the lock being of a kind which is disengageable from the locking mechanism by axial movement.

More particularly, the invention relates to such a lock, being especially although not exclusively for use in a motor vehicle, of the type in which the lock comprises: a fixed stator, a tubular intermediate sleeve which is mounted within the stator for rotation about the common axis of the rotor and the stator, the intermediate sleeve being fixed axially with respect to the stator; and a rotor which is mounted within the intermediate sleeve for rotation in the latter but which is fixed against movement in the axial direction within the intermediate sleeve. The rotor carries pallets which are displaceable radially by a key which is introduced axially into the rotor.

The lock is further of the type in which the pallets are fully retracted radially into the rotor when the key is the correct one, so that the rotor is then freely rotatable in respect to the intermediate sleeve and also with respect to the stator: a control lever for actuating the locking mechanism controlled by the lock is then enabled to be displaced in rotation. This control lever, which is part of the lock, is coupled to the rotor of the lock through an interposed driving member (referred to for convenience in this Application as a driving sleeve, it being understood that the driving member may take any suitable form and is not necessarily a sleeve as such). The rotor and the intermediate sleeve are however prevented from rotating with respect to each other by the pallets, when the key introduced into the rotor is not the correct one.

The lock is further of the type which includes an indexer which is moveable axially between a rest position and a disengaged position in response to rotation of the intermediate sleeve with respect to the stator, following rotation of the rotor by an incorrect key, thus axially displacing the driving sleeve to a disengaged position in which the driving sleeve is prevented from rotating with respect to the stator.

BACKGROUND OF THE INVENTION

The use of such a disengaging mechanism in the lock prevents the latter from being forced. In this connection, if a false key, or for that matter any other flat tool of adequate profile, is introduced into the rotor, and if an attempt is then made to turn the rotor, the disengaging mechanism causes the rotor and the intermediate sleeve to be freely pivotable within the stator without any forces of particularly high magnitude being exerted on the pallets.

In this connection, where excessively high forces are applied, the pallets can be damaged or even forcibly retracted, which would then ause the lock to become unlocked without the correct key, i.e. the lock can be forced.

Various mechanisms have in the past been proposed for achieving disengagement of the lock from the locking mechanism. One example of such a mechanism is described and shown in German patent specification DE44 10 783, in which the indexer consists of two balls which are received in two axial grooves formed in the inner periphery of the stator. These balls cooperate with ramps formed in the forward free end of the intermediate sleeve, so that when the intermediate sleeve is driven in rotation by the pallets of the rotor, the ramps in the intermediate sleeve cause the balls to be displaced axially forward within the grooves. The balls i.e. the indexer, then causes a driving member to be displaced axially forward against the action of a return spring which is interposed between the control lever and the driving member. The control lever and the driving member are coupled in rotation with each other. When the driving member is in its axially forward position, it is blocked against rotation with respect to the stator in such a way that the control lever for the locking mechanism is itself also prevented from being moved, thus making it impossible to unlock the locking mechanism.

In the mechanism shown in the above mentioned document, immobilisation of the indexing balls against rotation about the axis of the lock is ensured by their retention within the grooves. However, each time the mechanism is disengaged, the balls are subjected to a force which tends to displace them tangentially out of the axial groove, due to the fact that they cooperate with the intermediate sleeve and with the grooves of the stator: the cooperation of the balls with the intermediate sleeve, and in particular with the ramps of the latter, is through a first internal radial spherical cap member, while their cooperation with the grooves is through an external second radial cap member. The balls are thus subjected, each time the lock is disengaged, to a shear force, and the balls tend to damage the edges of the grooves in the stator and the ramps in the intermediate sleeve. This is particularly detrimental, because in the apparatus described and shown in the above mentioned document, no provision is made for preventing reengagement in the absence of the correct key. In this connection, if a false key is used, the rotor of the lock is rotated through several turns each time the balls come back into register with the ramps of the intermediate sleeves. The lock is reengaged and then once again disengaged if the rotation is continued. As a result, the components of the disengaging mechanism can very rapidly become sufficiently damaged to be inoperable. It is then easier to force the lock.

In European patent specification EPO647752A, some of the above mentioned drawbacks are overcome by fixing the indexer in rotation to the intermediate sleeve, while leaving the indexer free to rotate with respect to the stator when it is in the disengaged position. However, although that arrangement enables, firstly, good operation of the indexer to be obtained, and secondly, any reengagement of the mechanism to be prevented once the lock has been disengaged using an incorrect key or unauthorised tool, the relative disposition of the indexer and the driving member associated with it leads to difficulties in the assembly of the various components of the lock.

DISCUSSION OF THE INVENTION

The present invention proposes a design, in particular of the driving sleeve, which enables all of the components of the lock to be assembled together in the axial direction. This assembly operation can then readily be carried out using automated equipment.

According to the invention, a disengageable lock, especially for a locking mechanism for a motor vehicle, of the type in which the lock comprises: a fixed stator; a tubular intermediate sleeve which is mounted for rotation about its axis within the stator, and which is fixed axially with respect to the stator; and a rotor which is mounted for rotation in the intermediate sleeve and which is fixed axially within the intermediate sleeve, the rotor including means for locking the rotor with respect to the intermediate sleeve, the lock being further of the type in which the said locking means are retracted when a correct key is introduced into the rotor so as to permit free rotation of the rotor with respect to the intermediate sleeve and the stator, thus permitting actuation, in rotation, of a control lever for the locking mechanism which is coupled to the rotor of the lock through a driving sleeve (the term "driving sleeve" being intended to be interpreted in the broad sense mentioned above), the lock being also of the type in which the lock includes an indexer which is movable axially between a rest, or engaged, position and a disengaged position in response to rotation of the intermediate sleeve with respect to the stator as a consequence of the rotor being driven in rotation using an incorrect key, so as to displace the driving sleeve axially towards the disengaged position, in which the driving sleeve is blocked against rotation with respect to the stator, the indexer being fixed in rotation to the intermediate sleeve and to the rotor, so that the rotor is freely rotatable with respect to the stator when it is in the disengaged position, the said indexer comprising a ring element having rear axial guide lugs adapted to be received in corresponding notches which are formed in the intermediate sleeve and which are open in the axial front end of the intermediate sleeve, the said ring element including at least one catch which extends axially forwards towards a transverse face of the stator which is formed with an axial aperture in which the or each catch is received when the indexer is in its rest position, with the edges of this aperture being in the form of ramps so as to cause the catch or catches to be retracted out of the aperture when the intermediate sleeve pivots about its axis with respect to the stator, the lock being further of the type in which the driving sleeve and the indexer are fixed with respect to each other in the axial direction, and in which a spring biases the driving sleeve axially forward towards its engaged position which corresponds to the rest position of the indexer, is characterised in that the driving sleeve comprises two tubular body portions, namely a rear body portion and a front body portion of larger and smaller diameter respectively, in that the driving sleeve includes at its rear end an external radial collar portion or rear flange, over which the indexer is hooked by means of its catch or catches, so as to couple the indexer and driving sleeve together, so that the indexer is fixed axially but free to rotate, and in that a lug, adapted to be received in a recess in the stator when the driving sleeve is in its retracted or disengaged position, extends radially from the front end of the outer cylindrical surface of the rear body portion (i.e. the end having the larger diameter).

According to a preferred feature of the invention, the ring element of the indexer has at least one notch open axially towards the rear, in which a corresponding finger of the rotor, which extends axially forward, is received.

The stator preferably includes at least one aperture in which a corresponding lug of the driving sleeve is received when the driving sleeve is in its retracted or disengaged position.

The driving sleeve is preferably coupled in rotation with the control lever for the locking mechanism, by means of complementary axial keys and keyways.

According to another preferred feature of the invention, the rotor includes a cylindrical terminal body portion which is provided with at least one radial drive lug which is received in a corresponding recess of the driving sleeve when the latter is in its engaged position.

According to yet another preferred feature of the invention, the stator is substantially tubular;, the intermediate sleeve and the rotor are mounted for rotation within the stator; the front end of the stator includes an internal radial collar portion, an annular transverse rear face of which is an axial abutment face for engagement by the catch or catches of the indexer, the said rear face including the corresponding said aperture; and the said radial collar portion is formed with at least one recess which is open axially towards the front to define the recess in which the or each said lug of the driving sleeve is received when the latter is in its retracted or disengaged position.

Preferably, the driving sleeve includes, at its front axial end, an internal radial flange in which there is formed the notch or notches in which the radial drive lug or lugs of the rotor is or are received, the keyways for coupling the driving sleeve with the control lever being formed in the outer cylindrical surface of the front portion, having the smaller diameter, of the driving sleeve.

Preferably, the indexer has two said catches diametrically opposed on the ring element of the indexer, each of the said catches having an internal radial rebate defining a rearwardly facing radial surface which is adapted to cooperate with a front annular face of the external collar portion or rear flange of the driving sleeve, the back end face of this flange, i.e. that of the driving sleeve, being adapted to engage against a front face of the ring element of the indexer so as to couple the indexer axially with the driving sleeve.

According to a still further preferred feature of the invention, the rotor has a cylindrical central body portion which is mounted for rotation with the intermediate sleeve, and which is extended forward by an intermediate body portion of the rotor having a smaller diameter than the central body portion, the said intermediate body portion being extended by a terminal body portion of the rotor having a smaller diameter than the intermediate body portion, the or each drive lug being formed on the terminal body portion for rotating the driving sleeve, the central body portion and intermediate body portion of the rotor defining, at the junction between them, an annular transverse face which carries the axial finger or fingers arranged to cooperate with the corresponding said notch or notches of the indexer.

In a preferred embodiment of the invention, when a correct key is introduced into the rotor of the lock after the lock has been disengaged from the associated locking mechanism by use of an incorrect key, there is an intermediate axial position of the assembly consisting of the indexer and the driving sleeve, in which the or each catch of the indexer is partially received in the corresponding said aperture in the stator, the said lug or lugs of the driving sleeve being partially received in the corresponding said recess or recesses of the stator, the axial finger or fingers of the rotor being disengaged from the associated said notch or notches of the indexer, but with the radial drive lug or lugs of the rotor being also disengaged from the associated said notch or notches of the driving sleeve, so that the stator and the intermediate sleeve are coupled together in rotation through the indexer, the driving sleeve then being blocked against rotation by the stator, and the rotor being freely rotatable with respect to the indexer and with respect to the driving sleeve, whereby, by pivoting of the rotor, the drive lug or lugs of the rotor can be brought into register with the corresponding said notch or notches of the driving sleeve, so that the indexer and driving sleeve can together be returned by the said spring into the forward or engaged position.

Further advantages and features of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
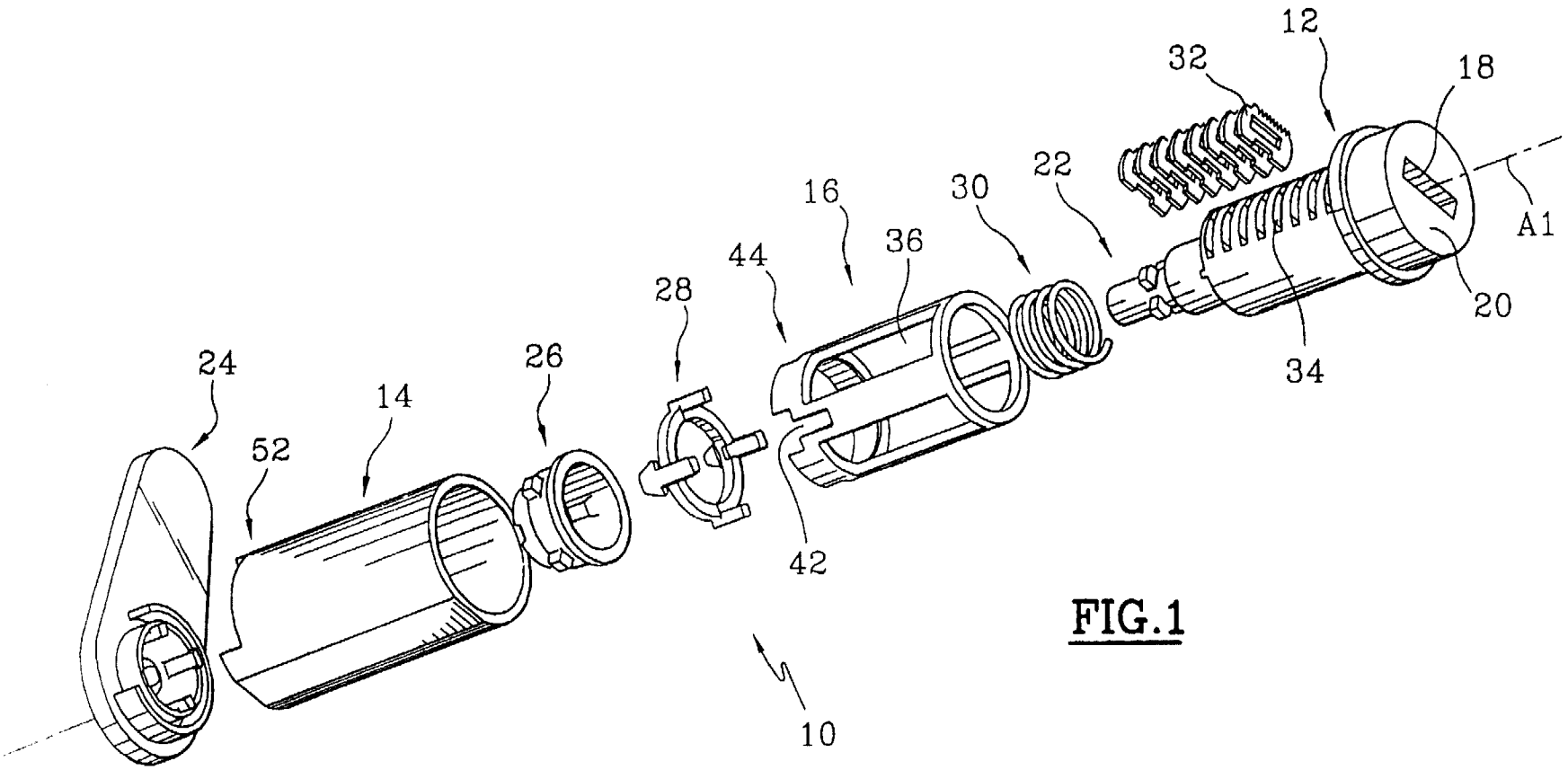
FIG. 1 is an exploded perspective view of the main elements of the disengageable lock in accordance with the invention.

FIG. 1 shows a rotary lock with a longitudinal axis A1, which includes a disengaging mechanism in accordance with the invention. The lock 10 consists essentially of a rotor 12 which is mounted for rotation about the axis A1 within a stator 14, with an intermediate sleeve 16 being interposed between the rotor 12 and the stator 14.

The rotor 12 is arranged to be driven in rotation by means of a key (not shown), which is introduced axially, forward from the rear, into the rotor 12 via a keyhole 18 which is formed in a rear transverse face 20 of the rotor 12. This face 20 is arranged for example to project on the outside of a bodywork panel (not shown) of the vehicle. The front axial end portion 22 of the rotor 12 is arranged to drive in rotation a control lever 24 for actuating a lock mechanism (not shown), for locking and unlocking a door or other opening part of the vehicle.

The rotor 12 is arranged to rotate the control lever 24 only in the presence of the correct key, through a driving sleeve 26 which is moveable axially within the lock 10 under the action of an indexer 28, between the engaged position (FIG. 8), in which it couples the rotor 12 with the control lever 24 for rotation together, and the disengaged position (FIG. 9), in which the rotor 12 is no longer able to actuate the lever 24. In the disengaged position, the driving sleeve 26 blocks the lever 24 against rotation with respect to the stator 14 of the lock.

The rotor 12, the stator 14 and the intermediate sleeve 16 are retained against axial movement in relation to each other along the axis A1, and a helical compression spring 30 is interposed between the rotor 12 and the driving sleeve 26 for biasing the latter axially forward into its engaged position.

Figure 2:
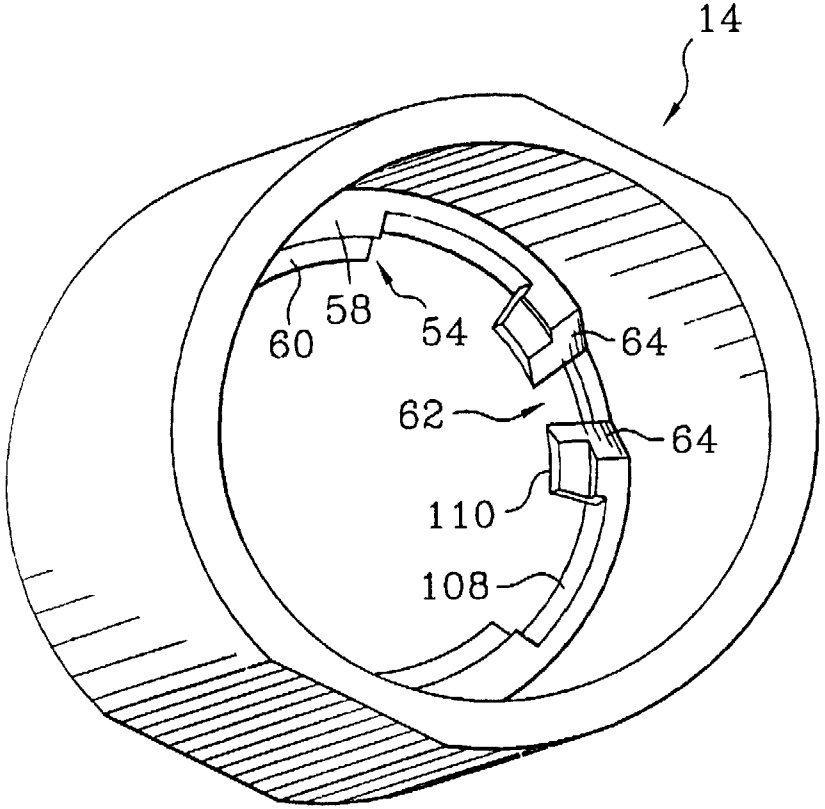
FIG. 2 is a perspective view showing the stator in greater detail.

As can be seen in FIGS. 1 and 2, the stator 14 is of a generally tubular cylindrical form, and it includes means (not shown) for mounting and fastening the lock on the vehicle.

In a manner known per se, the rotor 12 is arranged to receive pallets 32 which are disposed in transverse planes which are located in succession at regular intervals in the direction of the axis A1 of the lock 10. Each pallet is received in a corresponding housing 34 formed in the rotor 12. The pallets 32 are moveable radially within the rotor 12 and they are biased elastically towards a projecting position in which they project partly outside the pallet housings 34 in the rotor 12.

When the correct key is introduced into the rotor 12 and turned, the pallets 32 are fully retracted radially into the rotor 12. Thus, when the correct key is introduced into the rotor 12, the latter is able to pivot freely with respect to the cylindrical intermediate sleeve 16 and with respect to the stator 14.

If however an incorrect key, or any other tool, is introduced into the rotor 12, the pallets 32 are unable to be fully retracted, and are received in a corresponding window 36 formed in the intermediate sleeve 16. Thus, the pallets 32 immobilise the rotor 12 against rotation with respect to the intermediate sleeve 16, which itself remains freely rotatable with respect to the stator 14.

Figure 5:
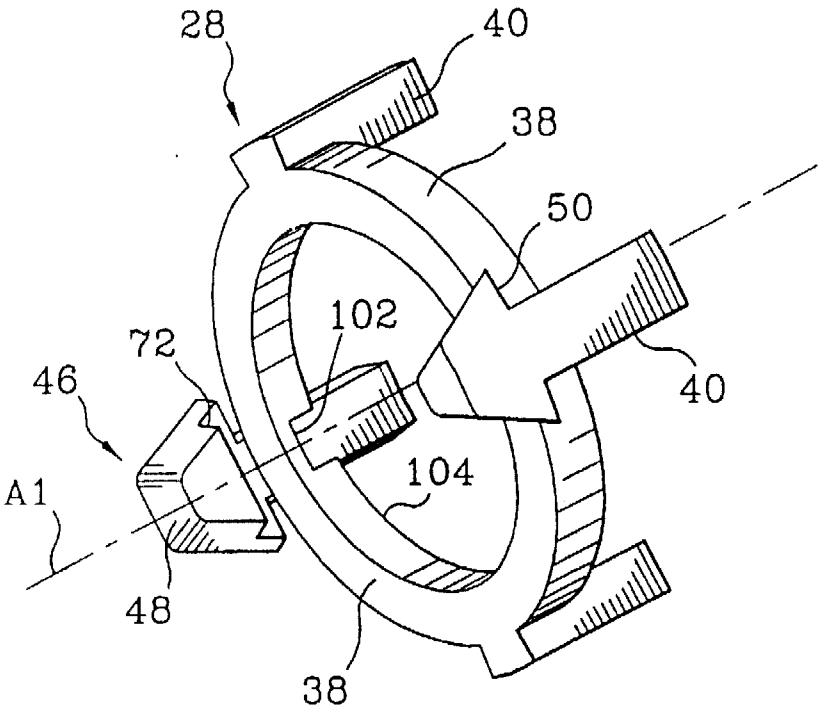
FIG. 5 is a perspective view showing the indexer in greater detail.

Reference is here made to FIG. 5 which shows the indexer 28 in detail. The indexer consists mainly of a ring element, or main ring, 38 and guide lugs 40, which extend axially towards the rear from the main ring 38. The guide lugs 40 are arranged to be received in corresponding axial notches (see FIG. 1) which are formed in the intermediate sleeve 16. The notches 42 are open axially towards the front in the front axial end 44 of the sleeve 16, so that with the guide lugs 40 they provide permanent rotational coupling of the indexer 28 to the intermediate sleeve 16 while allowing the indexer 28 to be displaced axially within the lock 10.

As can be seen in FIG. 5, the guide lugs 40 project radially with respect to the main ring 38 of the indexer, so that the main ring 38 can be received within the axial end 44 of the sleeve 16. Four of these guide lugs 40 are provided, being spaced apart at 90° intervals on the main ring 38 of the indexer.

The indexer 28 also includes two catches 46 which extend axially forward, and which constitute extensions of two of the guide lugs 40 diametrically opposed to each other. Each catch 46 has, in cross section through a plane tangential to the main ring 38, a substantially trapezoidal form symmetrical with respect to the axial direction. The minor base of this trapezium defines a transverse front edge 48 of the catch, while the major base of the trapezium defines two transverse surfaces 50 which project on either side of the longitudinal faces of the corresponding guide lug 40. Thus, each catch 46 with its associated guide lug 40 constitute a substantially arrow-shaped portion of the indexer 28, pointing forward in the axial direction.

The latches 46 are arranged to cooperate with the stator 14. In this connection, reference is made to FIGS. 2 and 5 in particular. The stator 14 includes at its front end 52 (FIG. 1) an internal radial collar portion 54 (FIG. 2), the rear transverse face of which is stepped so as to define two concentric annular faces 58 and 60. The first of these, a peripheral face 58, is disposed axially behind the second or inner face 60. The radial collar portion 54- is formed with apertures 62, the form of which is complementary to that of the catches 46 of the indexer 38, so that the two faces 64 that define each aperture 62 between them in the radial collar portion 54 are in the form of ramps 64. Each aperture 62 is open towards the rear.

The indexer 28 is thus able to occupy two axial positions within the stator 14. The first of these positions is a rest position, in which the catches 46 are in axial forward engagement within the corresponding aperture 62 in the stator 14.

Starting in this first position, if the indexer 28 is pivoted about its axis A1 within the stator 14, the catches 46 are brought out of the apertures 62, due to the inclination of the ramps 64 which flank the apertures 62. The indexer 28 is then in a rearwardly retracted axial position within the stator 14, being for example in engagement, through the front faces 48 of the catches 46, against the peripheral annular face 58 of the radial collar portion 54, FIG. 2.

As has been seen above, the indexer 28 is coupled in rotation to the intermediate stator 16. In this connection, if an incorrect key is introduced into the rotor 12, and if this incorrect key is used to cause the rotor 12 to pivot about its axis of rotation A1, the rotor 12 drives the intermediate sleeve 16 in rotation, so that the sleeve 16 also rotates the indexer 28. The indexer 28 is then displaced backwards towards its unlocked or disengaged position, due to the cooperation of the catches 46 with the inclined ramps 64 of the apertures 62.

The indexer 28 controls straight line displacements of the driving sleeve 26, so as to shift the Fatter from its forward axial position or engaged position, to a rearward axial, or disengaged, position.

Figure 7:
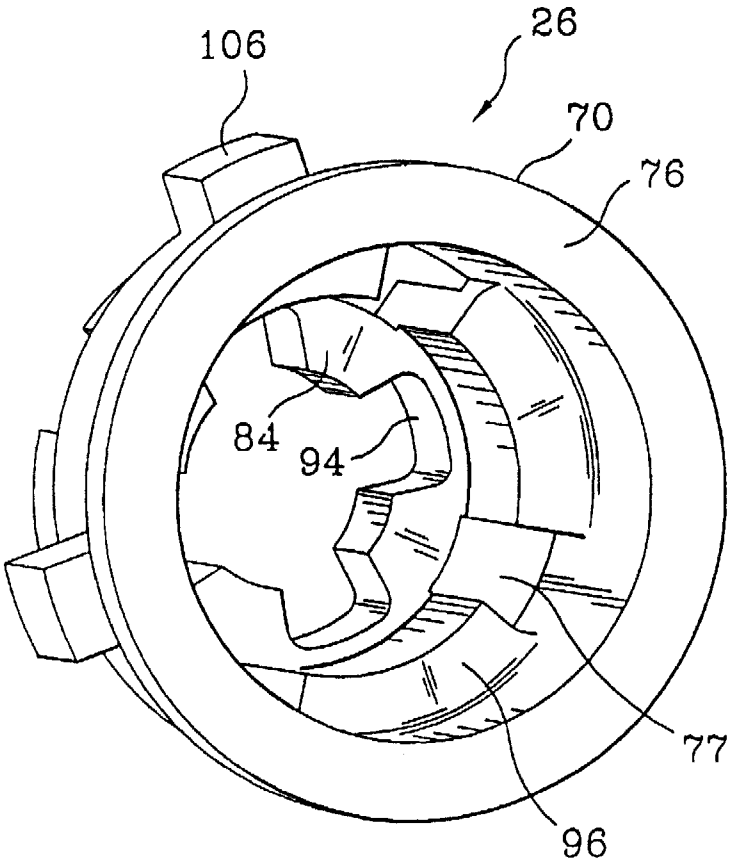
FIG. 7 is another perspective view of the driving sleeve, viewed from another direction.
Figure 6:
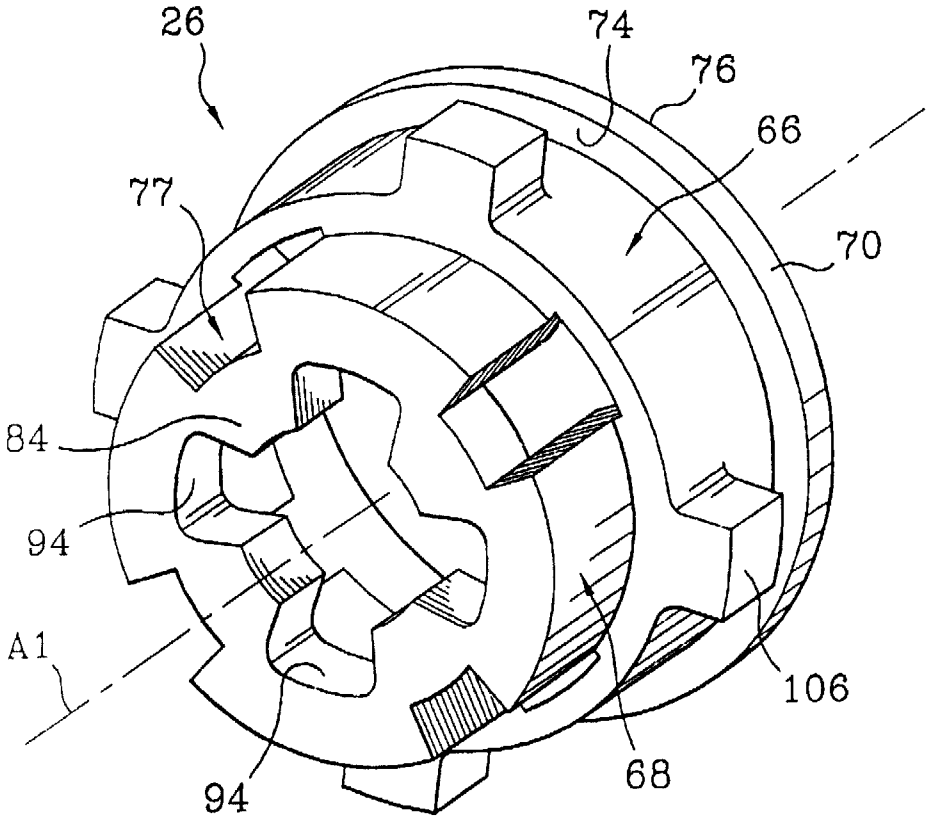
FIG. 6 is a perspective view of the driving sleeve viewed from one direction.

Reference is now made more particularly to FIGS. 6 and 7, showing the driving sleeve 26 itself. The sleeve 26 consists essentially of two successive coaxial tubular portions, namely a rear portion 68 and a front portion 68. The rear portion 66 has a greater diameter than the front portion 68. The rear portion 66 of the driving sleeve 26 includes at its rear end an external radial collar portion or rear flange 70, the outer diameter of which is substantially equal to that of the main ring 38 of the indexer 28. The rear flange 70 is arranged to cooperate with the catches 46 of the indexer 28, so as to couple the indexer 28 axially to the driving sleeve 26. In this connection, each of the catches 46 has at its inner or front end an internal radial rebate 72 which gives the catch 46 an L-shaped cross-section through a radial plane of the indexer 28.

The indexer 28 is in hooking engagement, by transverse engagement of the two catches 46, on the radial flange 70 of the driving sleeve 26, so that the rearwardly facing radial surface of the rebates 72 is in contact with the annular front radial face 74 of the rear flange 70 of the driving sleeve. The main ring 38 of the indexer 28 is then in axial engagement, through its radial front face, with the back end face 76, FIG. 7, of the driving sleeve 26. The driving sleeve 26 and the indexer 28 are thus coupled axially together. However, it should be noted that this coupling still enables the driving sleeve 26 and the indexer 28 to be free to rotate with respect to each other about their common axis A1.

Figure 4:
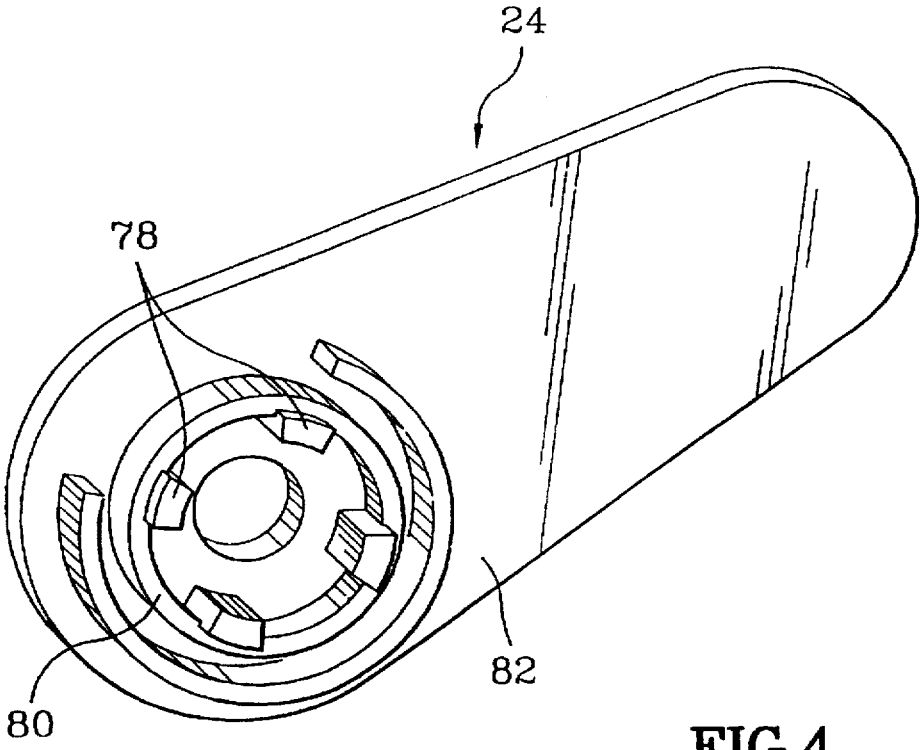
FIG. 4 is a perspective view showing the control lever in greater detail.

The front portion 68 of the driving sleeve 26 includes, on its outer cylindrical surface, keyways 77 which cooperate with complementary keys 78 of the control lever 24. In this connection, see in particular FIGS. 4 and 6. The keys 24 are formed in relief on an inner cylindrical face of a cylindrical crown portion 80 of the lever 24. This crown portion 80 projects axially towards the rear from a back face 82 of the lever 24. The driving sleeve 26 and the control lever 24 are adapted to be always coupled together for rotation together through the keys 78 and complementary keyways 77, regardless of the axial position of the driving sleeve 26, which is moveable within the lock 10, while the lever 24 is fixed axially with respect to the stator 14. In this connection the keys 78 of the lever 24 project axially backwards from the crown portion 80, while the keyways 77 of the driving sleeve 26 are open axially towards the rear, within the space which is defined by the cylindrical rear portion 66 of the driving sleeve 26.

The front cylindrical portion 68 of the driving sleeve 26 is formed with an internal flange 84 at its front end, as shown in FIG. 6. This flange 84 is interrupted by radial notches 94.

Figure 3:
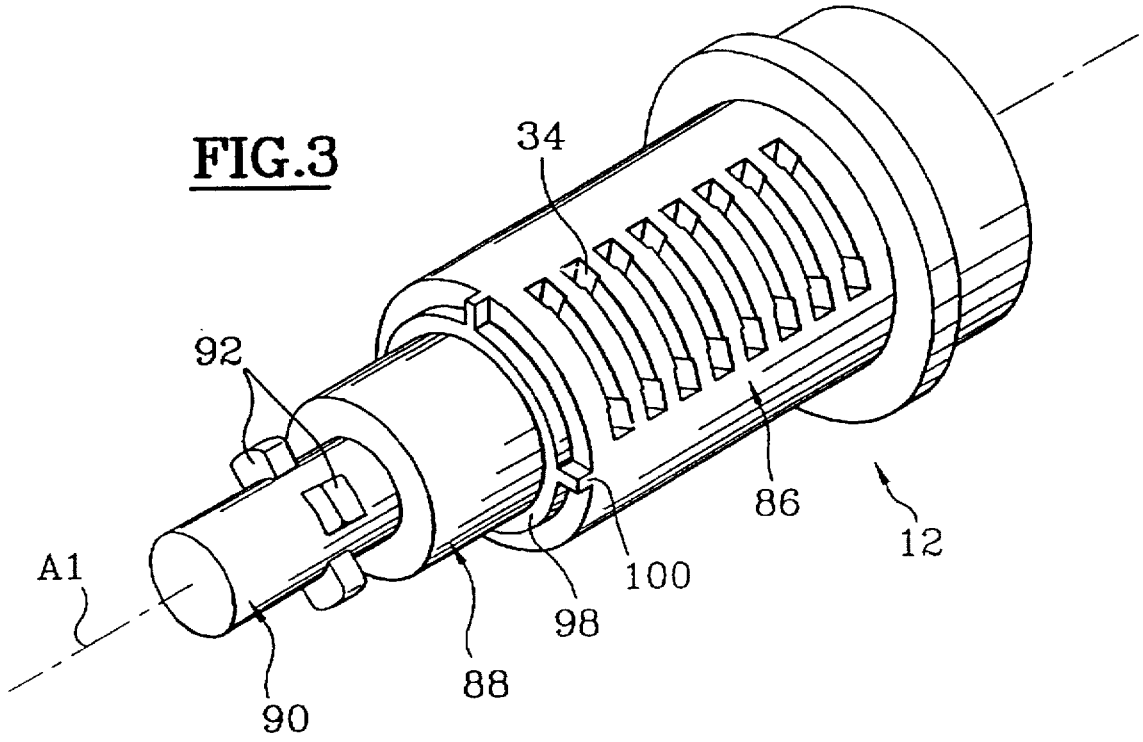
FIG. 3 is a perspective view showing the rotor in greater detail.

The driving sleeve 26 is mounted on the front of the rotor 12, FIG. 1. As is best seen in FIG. 3, the rotor 12 consists essentially of a central cylindrical body portion 86, in which the slots constituting the pallet housings 34 are formed. The central body portion 86 is extended axially forward by an intermediate body portion 88, which is itself extended further forward by a terminal body portion 90. The diameter of the body portion 88 is smaller than that of the body portion 86, and the diameter of the body portion 90 is smaller than that of the body portion 88.

The front, or terminal, body portion 90 of the rotor 12 is formed with four drive lugs 92, projecting radially outwardly and spaced apart by 90°. The drive lugs 92 are arranged to be received in the corresponding notches 94 formed in the radial flange 84 of the driving sleeve 26, FIG. 6, when the driving sleeve is in its engaged position. These notches 94 are open radially inwardly, arid axially towards both the front and the rear. The diameter o; the circular aperture defined by the radial internal flange 84 of the driving sleeve 26 is substantially equivalent to the external diameter of the terminal body portion 90 of the rotor 12. In addition, the drive lugs 92 of the rotor 12 are located at a distance from the rear end of the terminal body portion 90, i.e. the end at which the portion 90 joins the body portion 88, by an amount sufficient to enable the driving sleeve 26 to retract towards its disengaged position, in which the drive lugs 92 of the rotor 12 are disengaged from the notches 94 in the driving sleeve 26.

The internal diameter of the front tubular portion 68 of the driving sleeve 26 is substantially equal to the external diameter of the intermediate body portion 88 of the rotor 12, so that the intermediate body portion 88 can be received within the front portion 68 of the driving sleeve 26 when the latter is in its retracted or disengaged position.

In addition, the internal diameter of the rear tubular portion 66 of the driving sleeve 26 is greater than that of the front portion 68 and therefore greater than the external diameter of the intermediate body portion 88 of the rotor 12. In this way, an annular space is defined radially between the intermediate body portion 88 and the rear portion 66 of the driving sleeve 26. The compression spring 30, FIG. 1, which biases the driving sleeve 26 and the indexer 28 axially in the forward direction, is accommodated within this annular space.

The spring 30 is in axial engagement at the front against an annular thrust face 96, facing towards the of the driving sleeve 26, which cart be seen in FIG. 7. This annular face 96 defines the junction between the front portion 68 and rear portion 66 of the driving sleeve. The rear end of the spring 30 bears axially against another thrust face 98, which is a forwardly facing transverse annular face of the rotor 12, the thrust face 98 being at the junction between the central body portion 86 and the intermediate body portion 88 of the rotor.

The transverse thrust face 98 has a circumferential rebate on its outer radial periphery. This rebate is divided by four axial fingers, spaced apart by 90° from each other. The fingers 100 are arranged to be received when the indexer 28 is in its retracted or disengaged position, in corresponding notches 102, FIG. 5, which are formed in the rear transverse face, 104, of the main ring 38 of the indexer 28. As can be seen in FIG. 5, each notch 102 is aligned with a respective one of the guide lugs 40 of the indexer 28.

Thus, when after an incorrect key has been introduced into the rotor 12 the indexer 28 is in its retracted or disengaged position, it is prevented from rotating with respect to the rotor 12.

The driving sleeve 26 further includes lugs 106, FIGS. 6 and 7, which project radially outwards from the outer cylindrical surface of the rear portion 66 of the driving sleeve 26, as shown in FIG. 6. These lugs 106 are arranged to be received, when the driving sleeve 26 is in its retracted or disengaged position, within a corresponding recess 108 of the stator, FIG. 2. The recesses 108 are formed through the front transverse face 110 of the radial collar portion 54 of the stator 14. In the retracted or disengaged position, the driving sleeve 26 is thus prevented from rotating with respectively to the stator 14.

The recesses 108 of the stator 14 extend over an arc longer than the arc corresponding to the circumferential length of the lugs 106. This is necessary, because, when the driving sleeve 26 is retracted towards its disengaged position by the indexer 28, it continues to be driven in rotation by the rotor 12, until it does reach its disengaged position. Thus the driving sleeve 26 is displaced in substantially helical motion.

The extended length of the recesses 108 thus avoids the situation in which the lugs 106 would abut against the front face 110 of the radial collar portion 54, in which they would prevent the lock 10 from being disengaged. However, the size of these recesses 108 should not be made too great, so that the displacements of the lever 24 that are possible when the driving sleeve 26 is in its disengaged position will be limited as far as possible.

Figure 8:
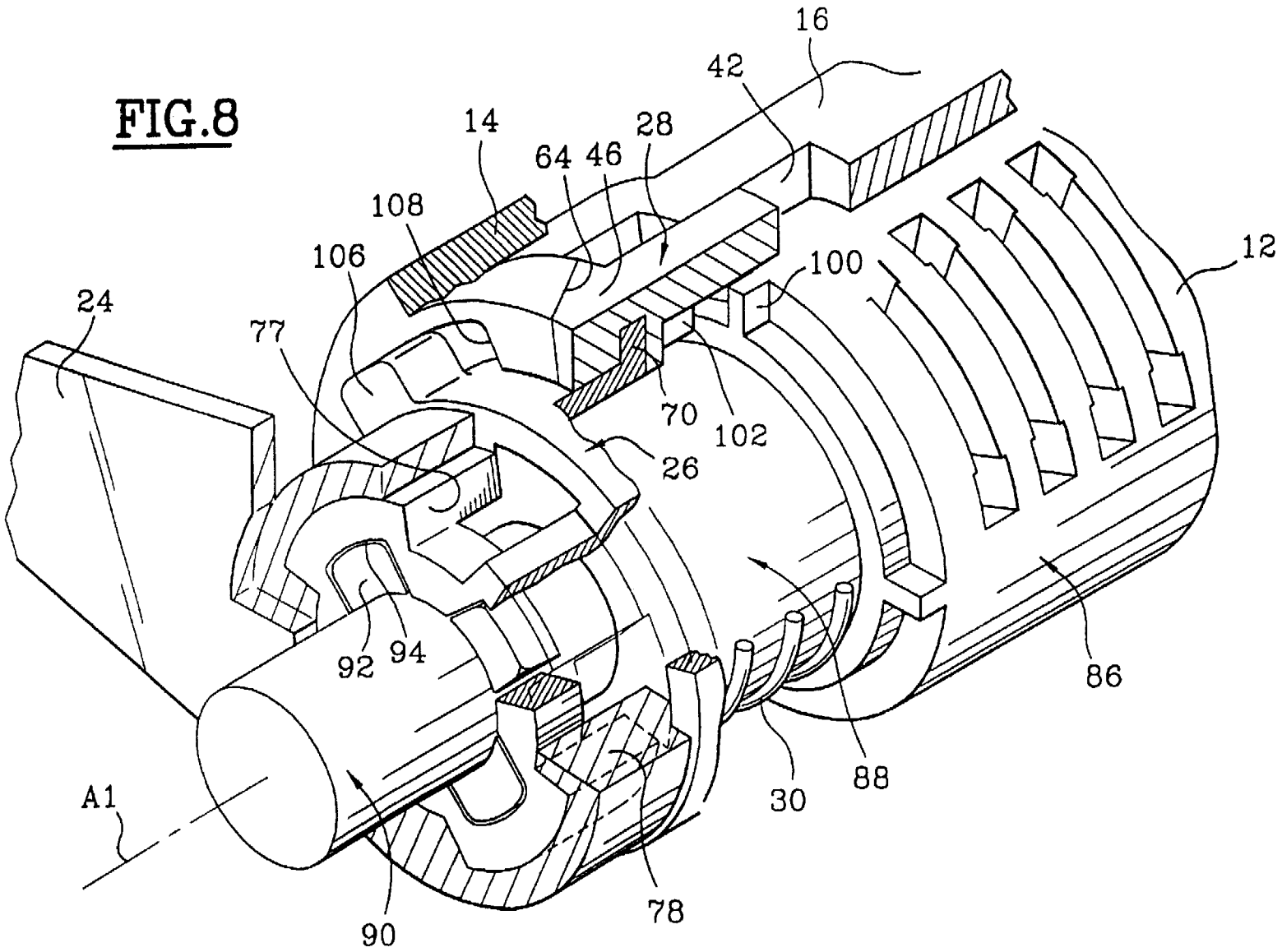
FIG. 8 is a diagrammatic perspective view of the lock in accordance with the invention, shown partly cut away, with the indexer and the driving sleeve shown in the engaged position.
Figure 9:
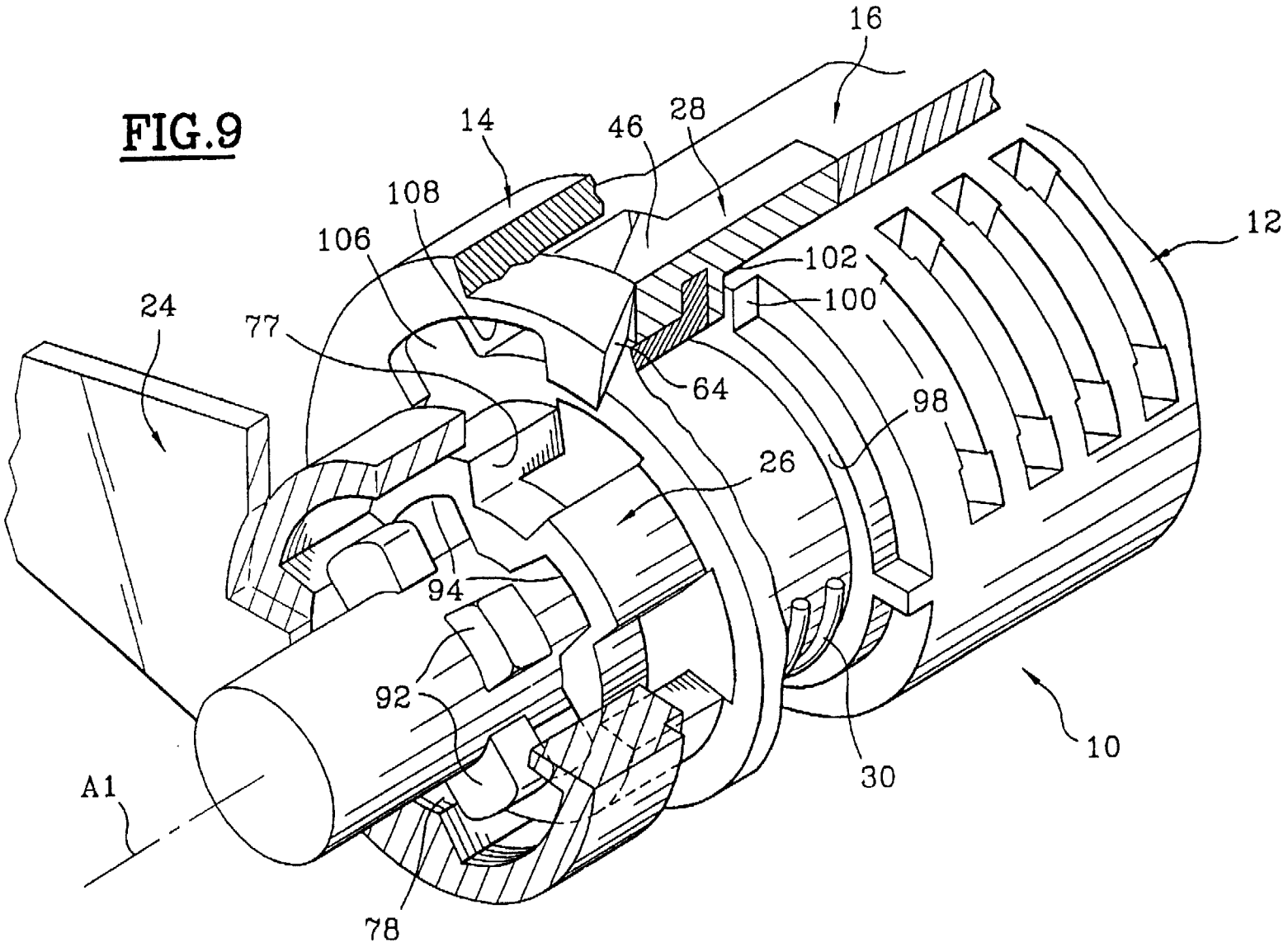
FIG. 9 is a view similar to FIG. 8 but showing the indexer and driving sleeve in the disengaged position.

The operation of the disengaging mechanism of the lock 10 will now described, with reference particularly to the diagrammatic perspective views shown in FIGS. 8 and 9. FIGS. 8 and 9 show the relative positioning of the various components of the lock, in the engaged and disengaged positions respectively.

FIG. 8 shows the lock 10 when the indexer 28 and the driving sleeve 26 are in their engaged, or advanced, position in which they enable the control lever 24 to be caused to rotate using the correct key.

In this condition, the catches 46 of the indexer 28 are received in the base of the apertures 62 in the stator 14, so that the spring 30 urges the indexer 28 and the driving sleeve 26 forward together. When the correct key is inserted, the pallets 32 are retracted into the rotor 12, and the intermediate sleeve 16 is freely rotatable with respect to the rotor 12, being immobilised with respect to the stator 14 due to the engagement of the catches 46 in the apertures 62. The driving sleeve 26 is in its advanced or engaged position so that, besides being coupled in rotation to the control lever 24 through the complementary keys 78 and keyways 77, it is also coupled in rotation to the rotor 12, due to the engagement of the drive lugs 92 of the rotor 12 in the corresponding notches 94 in the driving sleeve 26.

Thus, the rotor 12 is able to rotate the lever 24 so as to cause the associated locking mechanism to lock or unlock the vehicle door.

If on the other hand an incorrect key is introduced into the rotor 12, the pallets 32 retain the intermediate sleeve 16 in fixed relationship with the rotor 12 for rotation with it, so that any attempt to rotate the rotor 12 causes relative rotation of the intermediate sleeve to take place with respect to the stator 14. This rotation is permitted due to the fact that the indexer 28 retracts towards its disengaged position by the cooperation of the catches 46 with the ramps 64 in the apertures 62 of the stator 14.

The indexer 28, in retracting towards its disengaged position, carries the driving sleeve 26 with it into its disengaged position shown in FIG. 9. In this position, the drive lugs 92 of the rotor 12 are disengaged from the notches 94 in the driving sleeve 26, while the lugs 106 of the driving sleeve 26 are engaged in the recesses 108 of the stator 14. The driving sleeve 26 is thus prevented from rotating, and it prevents any rotation of the control lever 24, because the keys 78 remain engaged with the corresponding keyways 77 in spite of the relative axial displacement of the driving sleeve 26 with respect to the control lever 24.

In addition, the rotor 12 is no longer coupled in rotation to the driving sleeve 26, and is therefore totally free to rotate. The rotor 12 is thus disengaged from the rest of the lock and can no longer act on the latter.

Figure 10:
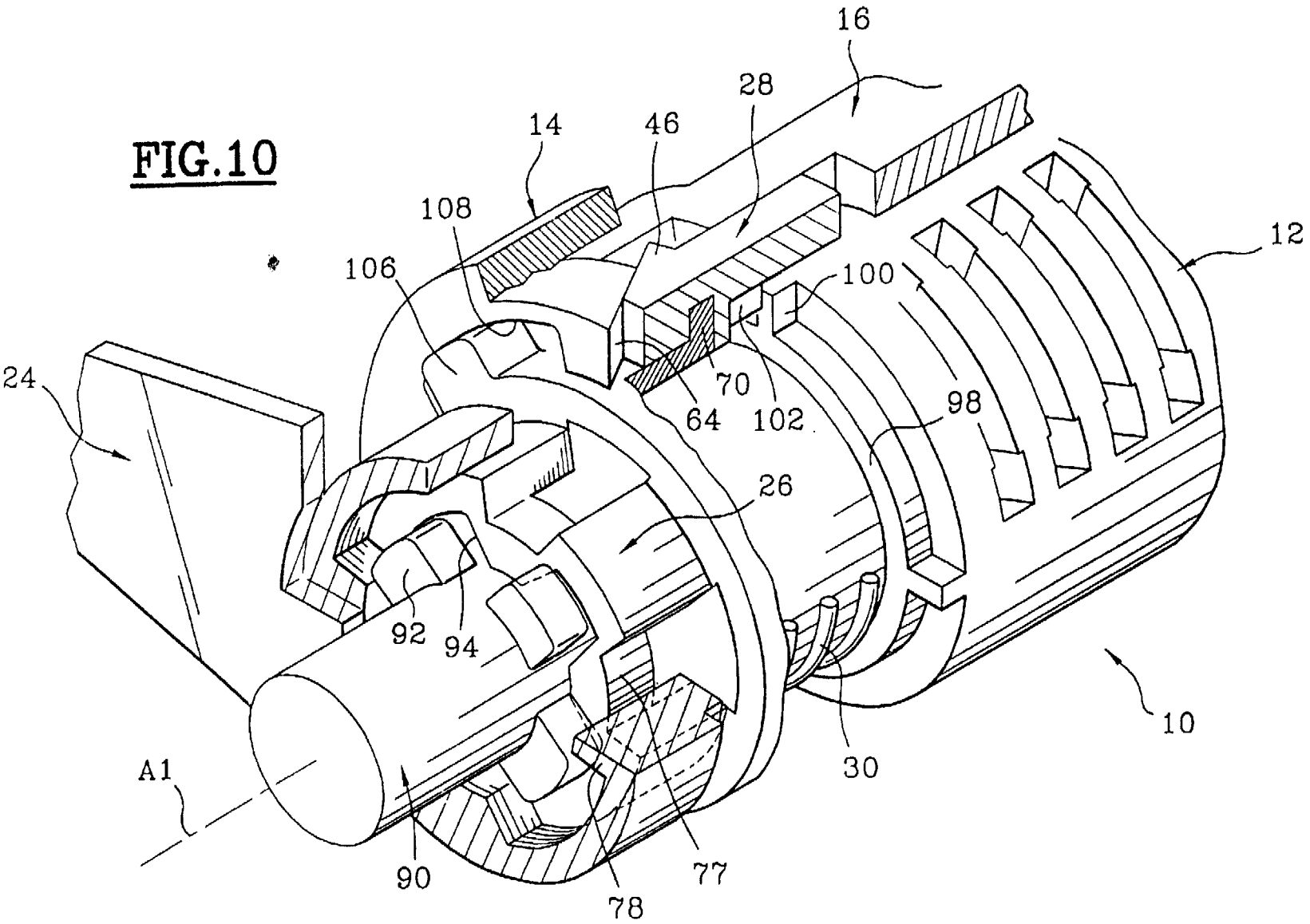
FIG. 10 is a view similar to FIG. 8 but shows the indexer and driving sleeve in the intermediate, or reengaging, position.

Reference is now made to FIG. 10, which shows the lock in an intermediate position of the driving sleeve 26 and indexer 28, between the engaged and disengaged positions shown in FIGS. 8 and 9 respectively. This intermediate position occurs after the lock has been disengaged from the associated locking mechanism, so that the indexer 28 and the driving sleeve 26 are in an initial position which is the disengaged condition shown in FIG. 9.

Starting from this position, rotation of the rotor 12 about its axis A1 causes the simultaneous rotation of the indexer 28 with respect to the stator 14. In this connection, when the correct key is being used, the indexer 28 is driven in rotation by the rotor 12 due to the engagement of the axial fingers 100 of the latter in the notches 102 of the indexer 28. However, if the key is not the correct one, the indexer 28 is driven simultaneously by the intermediate sleeve 16, which is fixed in rotation to the rotor 12 because the pallets 32 are not retracted into the rotor body.

After this rotation has taken place through a certain angle, the catches 46 of the indexer 28 will then come into register with the corresponding apertures 62 in the stator 14. The indexer 28 and driving sleeve 26 are now displaced by the spring 30 in a forward direction towards the engaged position.

However, it is then improbable that the drive lugs 92 of the rotor 12 will be in exact register with the corresponding notches 94 in the driving sleeve 26. This being so, the radial internal flange 84 of the driving sleeve is again in axial abutment at the front against the rear face of the drive lugs 92, thus preventing the driving sleeve 26 from reaching its engaged position. The lock is thus in the configuration shown in FIG. 10, i.e. the intermediate position of the indexer 28 and driving sleeve 26.

Correct axial positioning of the various elements of the lock 10 therefore enables two things to be achieved. The first of these is that the mechanism is prevented from becoming fully reengaged if the rotor 12 is actuated using an incorrect key. The second is that, when the key is the correct one, automatic re-engagement of the mechanism lock with the locking mechanism is ensured, requiring less than a quarter of a turn of the rotor 12.

The values of clearances and courses of travel which will be given below are quoted by way of example only, and are in no way limiting.

For example, a mechanism may be chosen in which the total course of axial travel of the indexer 28 and the driving sleeve 26 between their engaged and disengaged positions is slightly greater than 3 mm. It is then arranged that, in the engaged position, the drive lugs 92 of the rotor 12 are received in the recesses 94 of the driving sleeve 26 over an axial distance of the order of only 2 mm.

By contrast, when the indexer 28 is in the disengaged position it is chosen that the axial fingers 100 of the rotor 12 and the notches 102 in the indexer 28 will cooperate with each other only over an axial length of the order of 1 mm.

Finally, it is arranged that the lugs 106 of the driving sleeve 26 cooperate with the corresponding recesses 108 over a length of about 3 mm, substantially equal to the course of travel of the driving sleeve 26, though slightly shortly than the latter.

By adopting values such as those quoted above for the relative positions of the various elements of the lock, a situation is obtained in which, when the indexer 28 and the driving sleeve 26 are in the intermediate position (as in FIG. 10), i.e. in abutment against the drive lugs 92 of the rotor 12, the drive lugs 92 will have advanced through an amount in the axial direction which is slightly greater than 1 mm. The axial fingers 100 of the rotor 12 are then disengaged from the notches 102 of the indexer 28, but the lugs 106 of the driving sleeve remain trapped within the recesses 108.

Two different cases are then possible. In the first of these cases, if an incorrect key is introduced into the rotor 12, the intermediate sleeve 16 remains fixed in rotation to the rotor 12 because the pallets 32 are still projecting from the rotor, and any continued rotation of the rotor 12 will give rise to a fresh, complete disengagement from the associated locking mechanism. Thus, the indexer 28 and the driving sleeve 26 will not return to the fully engaged position if the key is not the correct one, and this enables any release of the control lever 24 with respect to the stator 14 be avoided.

The second of the two cases mentioned above is the one where the correct key is introduced into the rotor 12. Here, the rotor 12 and the intermediate sleeve 16 are released from each other in rotation, but the driving sleeve 26 remains blocked against rotation with respect to the stator 14. As a result, it is now possible to continue the rotation of the rotor 12 while holding the driving sleeve 26 perfectly immobile, so that the drive lugs 92 of the rotor 12 become displaced with respect to the radial flange 84 of the driving sleeve 26 until they come into register with the notches 94. By providing four drive lugs 92 spaced apart by 90°, and the same number of notches 94, this situation will occur at every quarter turn.

Thus, under the action of the spring 30, the driving sleeve 26 is able to advance to its engaged position, and the rotor 12 can then cause the control lever 24 to be rotated.

The lock 10 described above is a disconnectable high security lock, which nevertheless uses components which may be made in a simple way by moulding. The forces transmitted through the various components are such that the risks of deterioration of the various components are reduced by the greatest possible amount. Finally, the assembly of such a lock has been found to be easy to carry out using automatic assembly equipment.

What is claimed is:

1. A disconnectable lock for connection with a locking mechanism, the disconnectable lock comprising: a fixed stator defining an axis of the lock and having a front end and a rear end, a tubular intermediate sleeve fixed axially with respect to the stator but rotatable in the stator about the said axis; a rotor fixed axially in the intermediate sleeve and including releasable locking means for locking the rotor against rotation with respect to the intermediate sleeve, the rotor further having a keyhole and means mounting the said releasable locking means in the rotor for engagement of the locking means with a key when a key is inserted into the rotor through the keyhole, whereby when said key is a correct key, the key retracts the locking means into the rotor so as to enable the rotor to rotate freely with respect to the intermediate sleeve and with respect to the stator; a control lever at the front end of the stator; a driving member coupling the rotor to the control lever for rotational movement of the control lever by the rotor when the rotor is rotated with the said releasable locking means retracted into the rotor, the control lever being adapted to engage a said locking mechanism for actuation of the latter by said rotational movement of the control lever, the intermediate sleeve having means for engaging said releasable locking means in the absence of retraction of the releasable locking means into the rotor, so that when a said key is an incorrect key, rotation of the rotor thereby causes the intermediate sleeve to rotate with the rotor; and an indexer interposed between the intermediate sleeve and the driving member, for axial movement of the indexer between an engaged and rest position and a disengaged position of the indexer when the intermediate sleeve is rotated with respect to the stator by said rotation of the intermediate sleeve with the rotor in the presence of an incorrect key, whereby said axial movement of the indexer to said disengaged position displaces the driving member axially with respect to the rotor to a disengaged position of the driving member, in which the driving member is prevented from rotating further with respect to the stator, the indexer having means for coupling the indexer in rotation to the intermediate sleeve and the rotor when in its said disengaged position, in which the rotor is freely rotatable with respect to the stator, the said indexer comprising a ring element having rearwardly extending axial guide lugs, the intermediate sleeve having a front end, and further defining notches open in said front end of the sleeve for receiving the said guide lugs in the said disengaged position, the said ring element further carrying at least one catch projecting axially forward of the said ring element, the stator having a transverse face defining at least one axial aperture therein, the said at least one catch extending towards said transverse face of the stator whereby the or each said axial aperture of the stator receives a said catch when the indexer is in said rest position, the stator defining ramps flanking the or each said aperture therein, for guiding the said at least one catch out of the said at least one aperture when the intermediate sleeve is rotated about the said axis with respect to the stator, the driving member and indexer being fixed to each other in the axial direction; and a spring interposed between the rotor and the driving member for urging the driving member axially forward towards an engaged position of the driving member corresponding to the said rest position of the indexer, wherein the driving member comprises a rear portion and a front portion coaxial with the rear portion and disposed in front of the latter, the front portion being of smaller diameter than the rear portion, the said rear portion having a back end defining an external radial collar portion for engagement with the indexer whereby to couple the indexer with the driving member for relative movement in rotation but without relative axial movement being possible between the indexer and the driving member, the said back end of the driving member further having an outer cylindrical surface and at least one radial lug of the driving member projecting radially from the said cylindrical surface, and the stator having at least one recess for receiving the said at least one radial lug of the driving member when the driving member is in its disengaged position.

2. A lock according to claim 1, wherein the ring element of the indexer further defines at least one notch open axially towards the rear, the rotor having at least one forwardly projecting finger, the or each said finger being received in a corresponding one of the said at least one notch in the indexer.

3. A lock according to claim 1, wherein, the stator defines at least one radial recess, the driving member having at least one radial lug adapted to be received in a corresponding said recess of the stator when the driving member is in its disengaged position.

4. A lock according to claim 1, further including coupling means comprising first coupling elements on the driving member and second coupling elements on the control lever cooperating with the first coupling elements, one of said first and second elements being keys, the other being keyways, whereby to couple the driving member and control lever together in rotation.

5. A lock according to claim 1, wherein the rotor includes a terminal cylindrical body portion and at least one radial drive lug carried by said terminal body portion, the driving member defining at least one radial notch therein, the number of the said notches being the same as the number of the said drive lugs, whereby the or each drive lug is received in a corresponding said notch when the driving member is in its engaged position.

6. A lock according to claim 3, wherein the stator is substantially tubular, the intermediate sleeve and the rotor being mounted rotatably in the stator, the stator having a radially inwardly extending collar portion at its front end, the said collar portion having an annular transverse rear face, the latter being the said transverse face of the stator defining the said at least one axial aperture of the stator and constituting an abutment face for a said catch of the indexer, the said radial collar portion defining therein at least one interruption open axially to the front and constituting a said radial recess for receiving a said radial lug of the driving member when the driving member is in its disengaged position.

7. A lock according to claim 1, wherein: the stator defines at least one radial recess, the driving member having at least one radial lug adapted to be received in a corresponding said recess of the stator when the driving member is in its disengaged position; the lock further includes coupling means comprising first coupling elements on the driving member and second coupling elements on the control lever cooperating with the first coupling elements, one of said first and second elements being keys, the other being keyways, whereby to couple the driving member and control lever together in rotation; the rotor includes a terminal cylindrical body portion and at least one radial drive lug carried by said terminal body portion, the driving member defining at least one radial notch therein, the number of the said notches being the same as the number of the said drive lugs, whereby the or each drive lug is received in a corresponding said notch when the driving member is in its engaged position; and the driving member includes at its front end an internal radial flange defining the said at least one notch of the driving member for receiving the said at least one radial drive lug of the rotor, the said front end of the driving member having an external cylindrical surface defining the said first coupling elements.

8. A lock according to claim 1, wherein the indexer has two said catches diametrically opposed to each other on the said ring element, each said catch having an internal radial rebate, the said external radial collar portion of the driving member having an annular front face and a rear face, for cooperation of its said annular front face with the said rebates of the said catches, and the ring element of the indexer having a front face for axial abutment with the rear face of the radial collar portion of the driving member, whereby to couple the indexer and the driving member axially together.

9. A lock according to claim 2, wherein the rotor includes a terminal cylindrical body portion and at least one radial drive lug carried by said terminal body portion, the driving member defining at least one radial notch therein, the number of the said notches being the same as the number of the said drive lugs, whereby the or each drive lug is received in a corresponding said notch when the driving member is in its engaged position, the rotor further comprising a cylindrical central body portion and an intermediate body portion interposed axially between, and coaxial with, the central body portion and the terminal body portion, the intermediate body portion and central body portion being of larger diameter than the terminal body portion, the terminal body portion being at the front end of the rotor, the rotor defining a transverse annular face at the junction of the central and intermediate body portions, the said at least one finger of the rotor being carried by the said transverse annular face.

10. A lock according to claim 2, wherein the rotor includes a terminal cylindrical body portion and at least one radial drive lug carried by said terminal body portion, the driving member defining at least one radial notch therein, the number of the said radial notches being the same as the number of the said drive lugs, whereby the or each drive lug is received in a corresponding said radial notch when the driving member is in its engaged position, the lock being so configured so as to define, for an assembly consisting of the indexer and the driving member, an intermediate axial position between the said engaged and disengaged positions when, the lock having been put in its disengaged position with an incorrect key, a correct key is introduced into the rotor, the said intermediate axial position being one in which: the or each said catch is partially received in the corresponding said aperture in the stator; the or each said radial lug of the driving member is partially received in the associated recess in the stator; the or each said finger of the rotor is disengaged from the corresponding said notch of the indexer; and the or each said drive lug of the rotor is also disengaged from the corresponding said radial notch of the driving member, so that the stator and the intermediate sleeve are coupled together in rotation by the indexer, the driving member being prevented from rotating by the stator, and the rotor being free to rotate with respect to the indexer and with respect to the driving member, whereby rotation of the rotor is able to bring the or each said drive lug of the rotor into register with the corresponding said radial notch in the driving member, so that the said spring can return the indexer and driving member to their engaged position.

* * * * *